US010288378B2

(12) United States Patent
Minor et al.

(10) Patent No.: US 10,288,378 B2
(45) Date of Patent: May 14, 2019

(54) SELF-LEVELING SCOPE MOUNT AND METHOD

(71) Applicant: Lightforce USA, Inc., Orofino, ID (US)

(72) Inventors: Grant Matthew Weld Minor, Troy, ID (US); Corey Q. Runia, Orofino, ID (US)

(73) Assignee: Lightforce USA, Inc., Orofino, ID (US)

( * ) Notice: Subject to any disclaimer, the term of this patent is extended or adjusted under 35 U.S.C. 154(b) by 15 days.

(21) Appl. No.: 15/685,131

(22) Filed: Aug. 24, 2017

(65) Prior Publication Data

US 2018/0058813 A1 Mar. 1, 2018

Related U.S. Application Data

(60) Provisional application No. 62/378,877, filed on Aug. 24, 2016.

(51) Int. Cl.

| | |
|---|---|
| ***F41G 1/44*** | (2006.01) |
| ***F41G 1/387*** | (2006.01) |
| ***F41G 1/46*** | (2006.01) |
| ***F41G 1/54*** | (2006.01) |
| ***F41G 11/00*** | (2006.01) |

(52) U.S. Cl.

CPC ..... *F41G 1/44* (2013.01); *F41G 1/387* (2013.01); *F41G 1/46* (2013.01); *F41G 1/545* (2013.01); *F41G 11/003* (2013.01)

(58) Field of Classification Search

CPC . F41G 1/387; F41G 1/393; F41G 1/44; F41G 1/545; F41G 11/001

USPC ..... 42/124–127, 119

See application file for complete search history.

(56) References Cited

U.S. PATENT DOCUMENTS

| | | | | | |
|---|---|---|---|---|---|
| 1,974,016 | A * | 9/1934 | Doe | F41G 11/007 | 42/126 |
| 2,125,828 | A * | 8/1938 | Turner | F41G 11/001 | 42/127 |
| 2,659,150 | A * | 11/1953 | Feerick | F41G 11/001 | 42/127 |
| 3,177,587 | A * | 4/1965 | Hart | F41G 11/002 | 42/126 |
| 3,324,558 | A * | 6/1967 | Hart | F41G 11/007 | 42/127 |
| 6,708,439 | B1 * | 3/2004 | Laitala | F41G 11/002 | 42/124 |

(Continued)

*Primary Examiner* — Reginald S Tillman, Jr.

(74) *Attorney, Agent, or Firm* — Wood Herron & Evans LLP

(57) ABSTRACT

Provided is a self-leveling mount for attaching a sighting scope, having a longitudinal optical axis, to a firearm, having a longitudinal barrel axis. The mount includes a body attachable to a firearm, a pair of scope attachment rings axially spaced apart relative to the body so that at least a portion of the body is situated between the attachment rings, and a vertically movable contact plate on the base between the rings. The plate presents an upper surface that is horizontally perpendicular to the longitudinal axes of a firearm barrel and scope held by the attachment rings. The contact plate makes adjustable alignment contact with a bottom surface of the scope held by the attachment rings to properly orient the scope relative to the firearm.

10 Claims, 7 Drawing Sheets

(56) References Cited

U.S. PATENT DOCUMENTS

| | | | |
|---|---|---|---|
| 8,196,332 | B2 | 6/2012 | Brentzel |
| 9,289,867 | B2 | 3/2016 | Turner, Jr. et al. |

* cited by examiner

SELF-LEVELING SCOPE MOUNT AND METHOD

RELATED APPLICATIONS

This application claims priority to U.S. Provisional Patent Application No. 62/378,877, filed Aug. 24, 2016, and incorporates the same herein by reference.

FIELD OF THE INVENTION

The present invention relates to an apparatus for mounting a telescopic sight (rifle scope) to a firearm, air gun, or crossbow. More particularly, it relates to a mount that assures correct positioning of the scope and its internal sighting reticle relative to the firearm.

BACKGROUND OF THE INVENTION

Telescopic sights or riflescopes are used for precisely aiming firearms. To provide an accurate aiming indication, particularly for longer-range shots, it is important that the scope and its internal sighting reticle are properly positioned over the barrel of the firearm. The reticle, which typically includes at least one horizontal line and one vertical line, must be oriented relative to the barrel such that the horizontal crosshair is exactly level when the vertical crosshair is exactly vertically aligned with the axial center of the barrel bore. Because riflescopes are typically used for aiming at targets a sufficient distance away from the shooter that the projectile will drop by force of gravity an appreciable distance before reaching the target, if the reticle of the scope is not properly oriented relative to the barrel, the "drop" will appear to have a lateral component, causing the target to be missed or the expected amount of bullet drop to be miscalculated.

Modern riflescopes include a tube with optical lenses at each end and a reticle positioned generally at some midpoint there between. The reticle may be "zeroed" or adjusted vertically by an elevation adjustment mechanism and laterally by a windage adjustment mechanism. These adjustment mechanisms are generally mounted on an enlarged portion of the scope body known as the saddle. The bottom exterior surface of the saddle is often flat or includes a flat portion and the manufacture builds the scope with the reticle squared to this flat bottom surface at the factory. Thus, if this exterior bottom surface is positioned exactly horizontally when the scope is mounted to the firearm (i.e., exactly perpendicular to the vertical crosshair's alignment with the axis of the barrel bore), the internal reticle will be properly aligned.

Various methods have been used in the past for adjusting a rifle scope in mounting rings to assure proper alignment. Some methods use a bubble level or protractor-like apparatus that can be attached to the scope body during installation. Others have used a shim to fit between a known horizontal top surface of the firearm or mount to check the position. Each of these requires a separate device, precise measurements by the installer, or a shim of an exact size.

SUMMARY OF THE INVENTION

The present invention provides a mounting unit for attaching a scope to a firearm (or air gun) with an adjustable or self-adjusting contact plate for providing proper alignment with an external surface of the scope to assure exact and proper alignment of the reticle relative to the firearm.

According to one embodiment, a self-leveling mount is provided for attaching a sighting scope, having a longitudinal optical axis, to a firearm, having a longitudinal barrel axis. The mount may include a body attachable to a firearm, a pair of scope attachment rings axially spaced apart relative to the body so that at least a portion of the body is situated between the attachment rings, and a vertically movable contact plate on the base between the rings. The plate presents an upper surface that is horizontally perpendicular to the longitudinal axes of a firearm barrel and scope held by the attachment rings. The contact plate may be vertically adjustable to provide alignment contact with a bottom surface of the scope held by the attachment rings to properly orient the scope relative to the firearm.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION OF THE INVENTION

Figure 1:
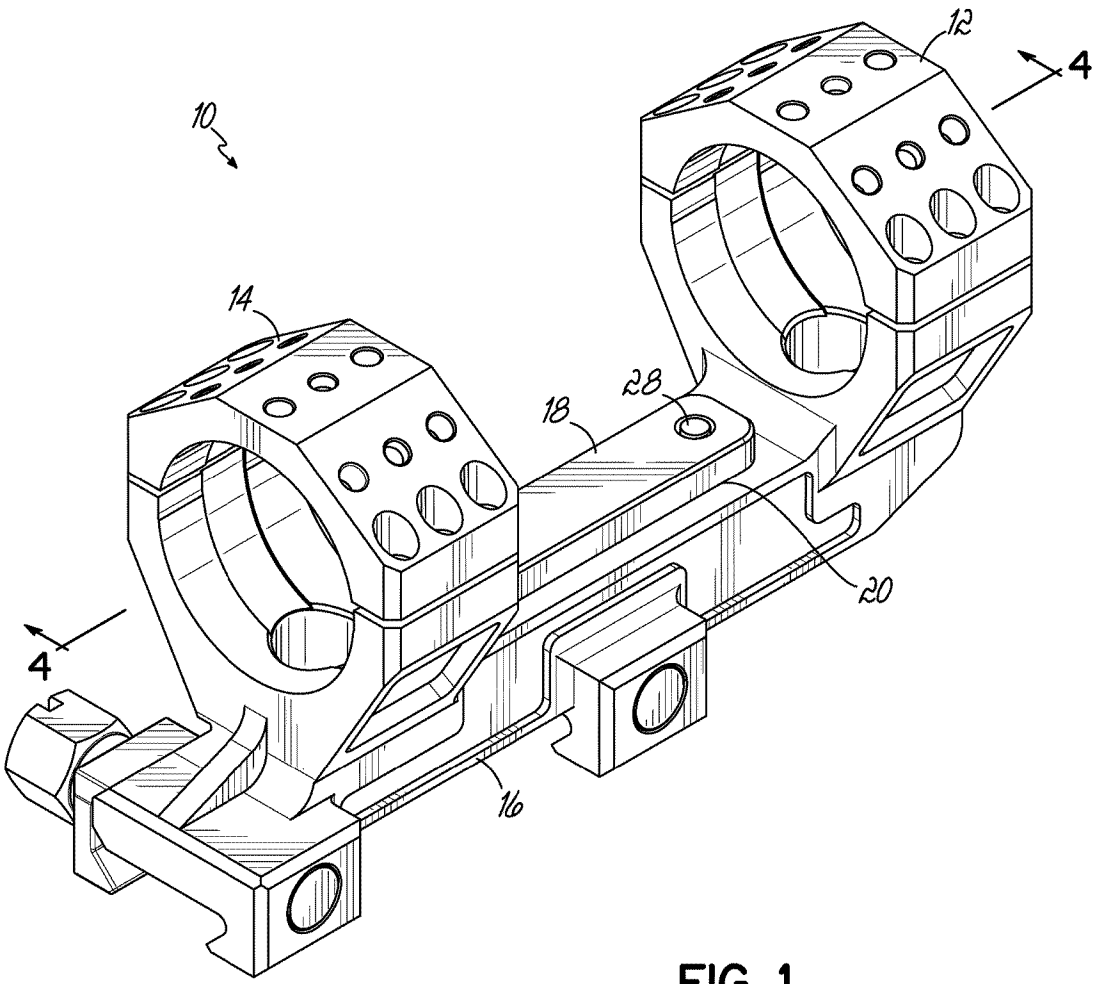
FIG. 1 is an upper isometric view of a self-leveling scope mount according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
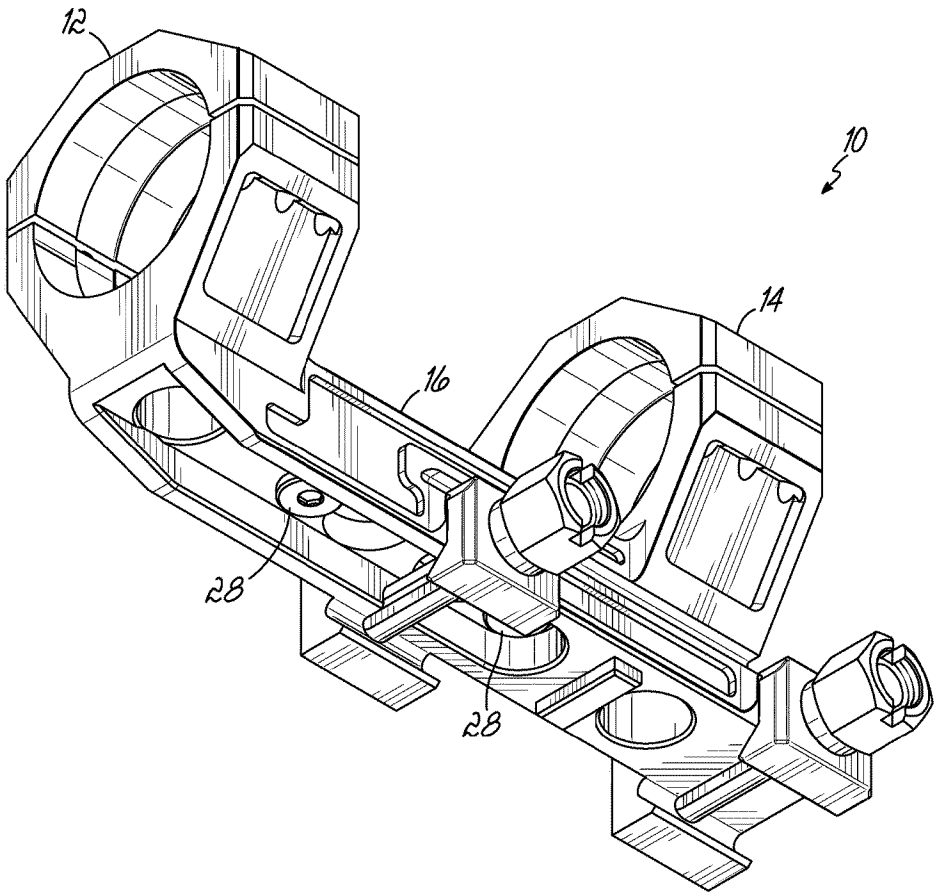
FIG. 2 is a lower isometric view thereof.

Referring first to FIGS. 1 and 2, therein is shown at 10 a scope mount unit according to one embodiment of the present invention. This embodiment provides a unitary mount integrating a pair of axially spaced-apart mounting rings 12, 14 and a base 16 that is removably attachable to a standard mounting rail according to any of a variety of well-known attachment means. The mounting rings 12, 14 may be integral with the base 16, as in the illustrated embodiment, or may be separate or separable from the base 16. As used herein, "axial" refers to the longitudinal optical axis of a rifle scope and the longitudinal axis of the firearm's barrel, both of which are well known to a person of ordinary skill familiar with firearms and optical sights. As used herein, "firearm" can include any type of handgun, rifle, or pistol, including air guns or crossbows.

Figure 3:
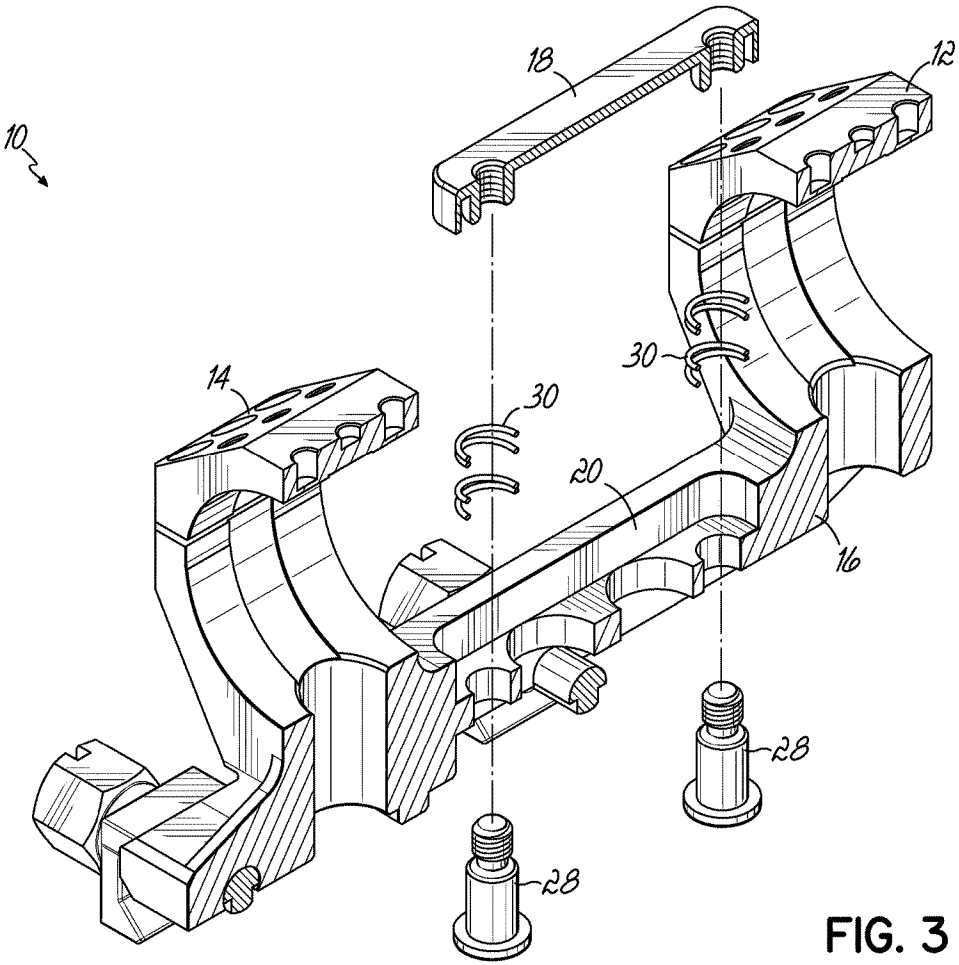
FIG. 3 is a longitudinally sectioned, exploded isometric view thereof.
Figure 4:
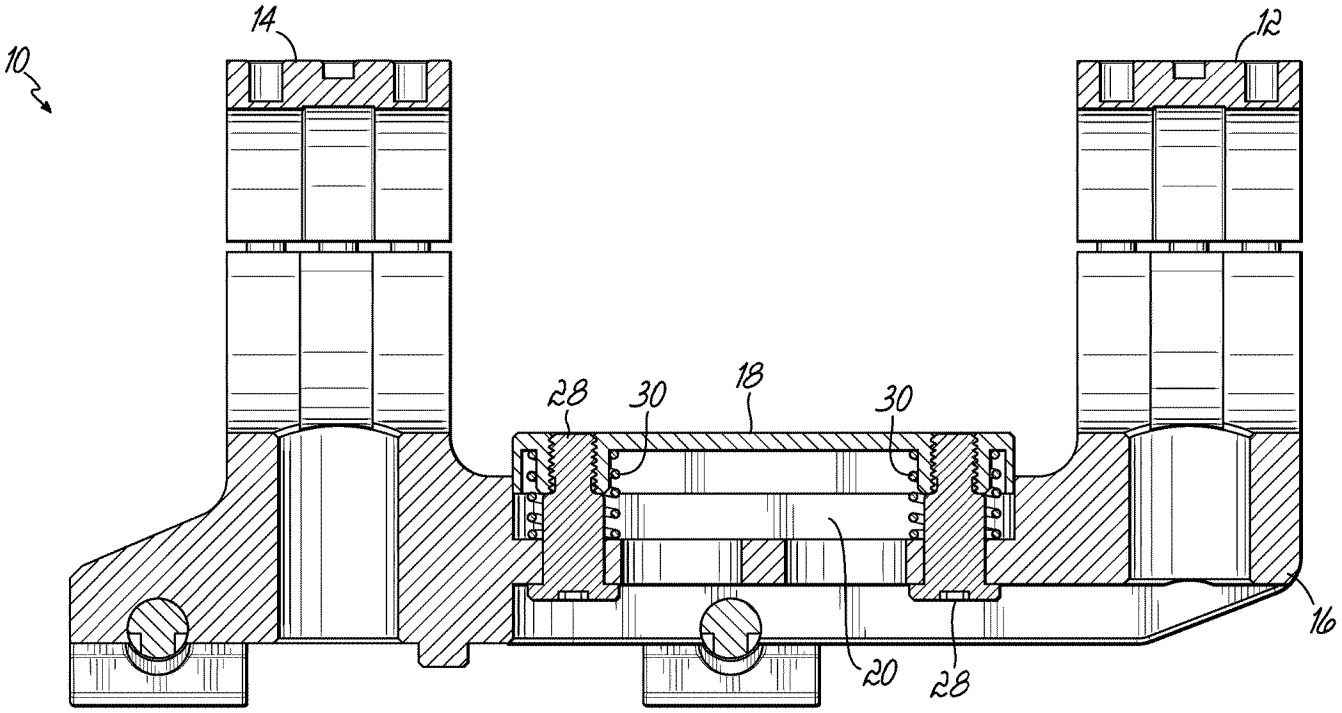
FIG. 4 is a side sectional view thereof taken substantially along line 4-4 of FIG. 1.
Figure 5:
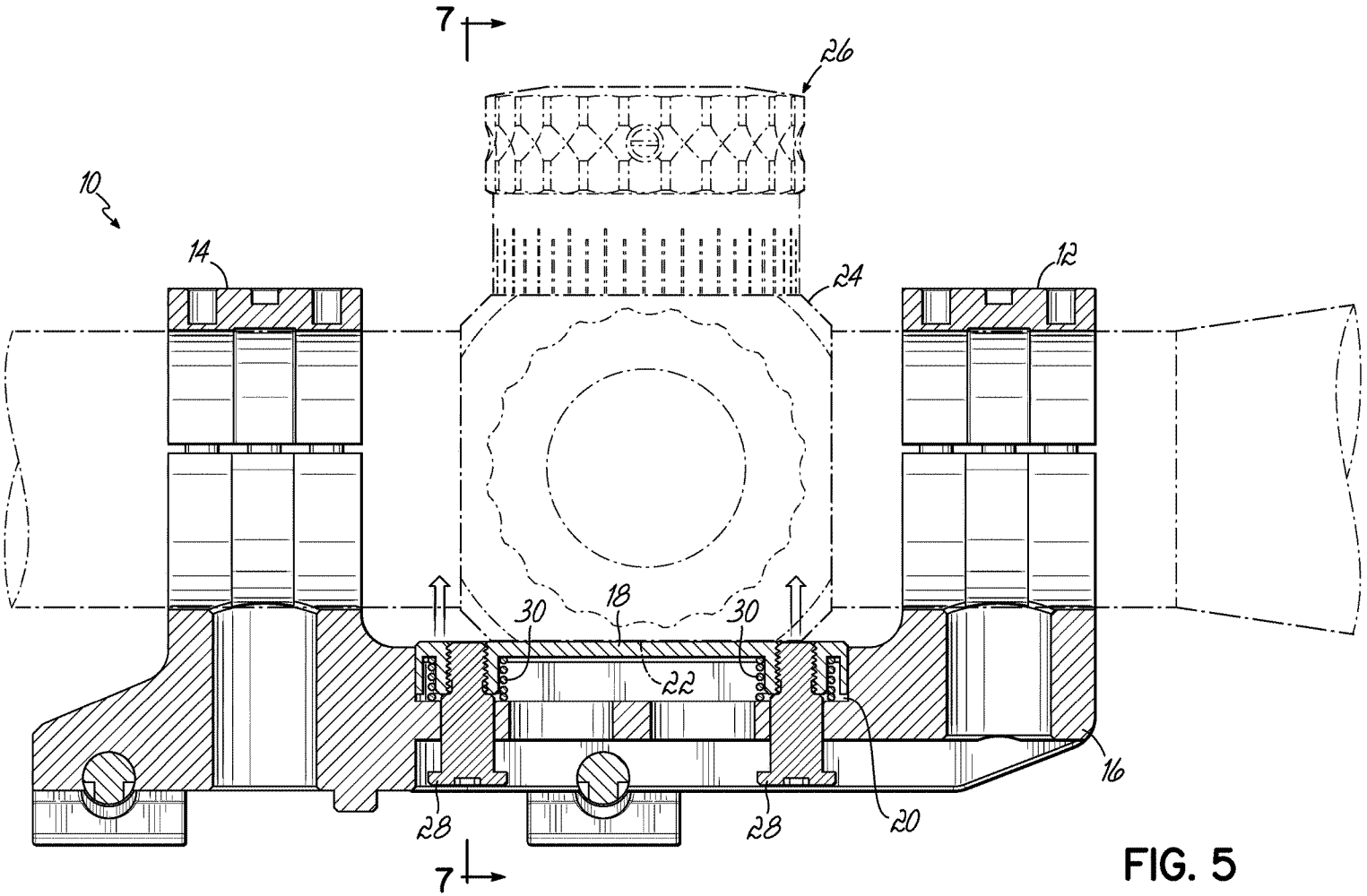
FIG. 5 is a side sectional view similar to FIG. 4 with the position of a rifle scope partially shown in phantom line.

Referring now also to FIGS. 3 and 5, the base 16 can include a mechanism for contacting a flat bottom surface of a rifle scope saddle to cause the scope to be properly aligned. This alignment may be facilitated manually or automatically. In the illustrated embodiment, a contact plate 18 is provided on a body portion of the base 16 for truing the position of the riflescope to the mount 10, and thus to the firearm, by contact with a flat bottom surface of a portion of the scope, such as the saddle portion 24.

In the illustrated embodiment, the contact plate 18 is elongated to extend a significant portion of the distance between the mounting rings 12, 14 so that a range of axial positions of the scope may be accommodated, such as to provide proper eye relief. The contact plate 18 may correspond in size and shape to a pocket 20 formed on the upper side of or through the base 16 for receiving the plate 18. The contact plate 18 may be vertically adjustable manually or, as illustrated, spring-biased toward a bottom surface 22 of the saddle portion 24 of the scope 26 (shown in phantom lines). The depth of the pocket 20 and height of the contact plate 18 may be selected to allow the top surface of the plate to be coplanar with a top surface of the base 16, or to extend a significant distance above the base. This allows the unit 10 to accommodate a variety of models and/or brands of riflescope 26*s*. The contact plate 18 may be retained to the base 16 by longitudinally spaced-apart fasteners 28 that allow the contact plate 18 to move vertically relative to the base 16. Springs 30 positioned coaxial with the fasteners 28 can bias the contact plate 18 upwardly to the limit allowed by head portions of the fasteners 28.

Figure 6:
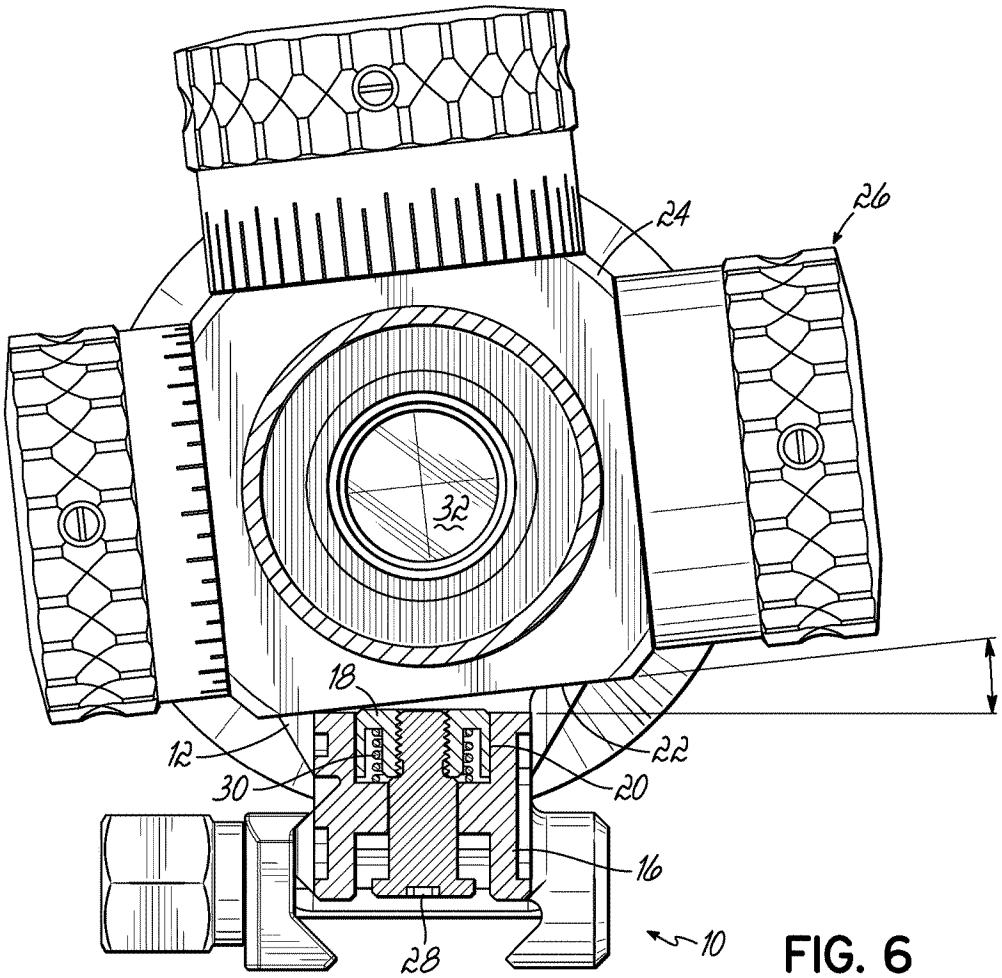
FIG. 6 is an end sectional view showing a rifle scope misaligned with the mount.
Figure 7:
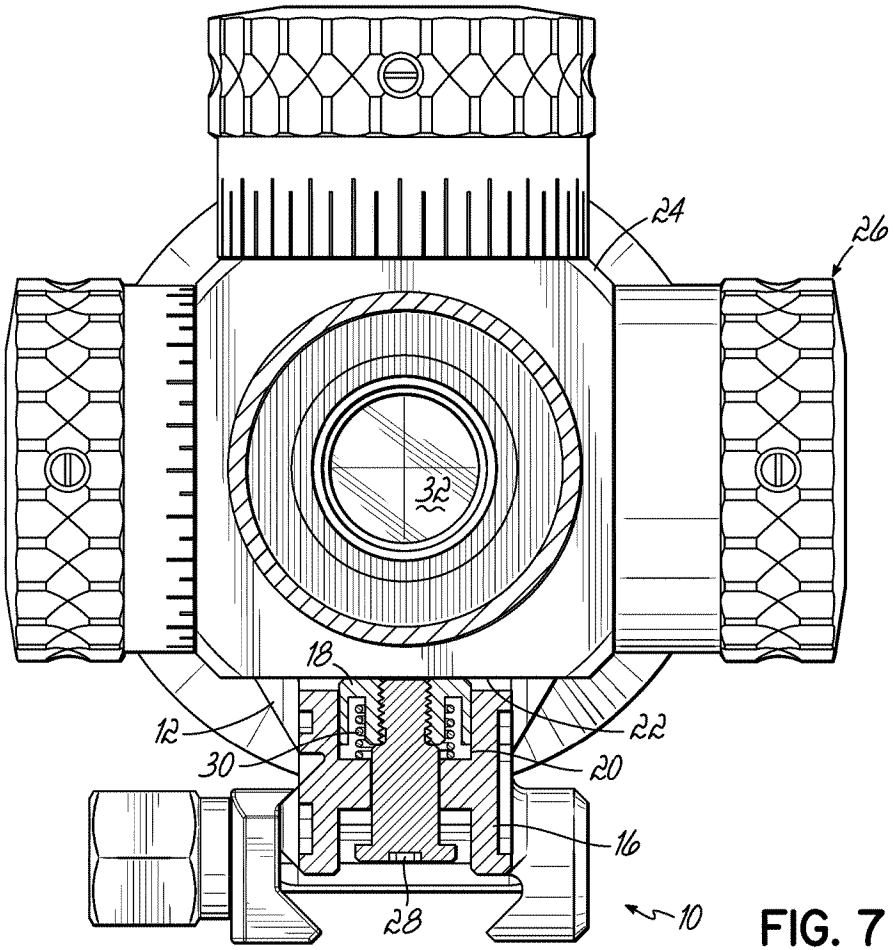
FIG. 7 is a similar view showing the scope properly aligned thereto.

Referring now to FIGS. 6 and 7, it can be seen how an embodiment of the invention functions in use. The scope mount unit 10 and or base 16 may be manufactured to align as precisely as possible with the rifle when mounted thereon. The accuracy of this alignment is subject to the accuracy of the firearm's mounting rail relative to the action and barrel (not shown). In turn, the mounting plate 18 will be oriented squarely to the rifle. When a scope 26 is improperly oriented (illustrated in an exaggerated state in FIG. 6) in the mount 10, the flat surfaces of the contact plate 18 and bottom surface 22 of the saddle 24 are not in full, coplanar contact with each other, which can be observed by the person installing the scope 26. When the scope 26 is misaligned, as shown in FIG. 6, the cross hairs of the reticle 32 will not be properly oriented relative to the mount unit 10, base 16, or the firearm to which it is attached. While a scope 26 is held loosely by the mounting rings 12, 14 during initial installation, or when the mounting rings 12, 14 are loosened for readjustment, the scope 26 may be axially rotated until the flat bottom surface 22 of the saddle 24 is exactly parallel to or coplanar with the upper surface of the contact plate 18.

The contact plate 18 may be moved manually or by force of the springs 30 into a state of face-to-face contact, as shown in FIG. 7. Alternatively, if the mounting rings 12, 14 are sufficiently lose and the biasing springs 30 sufficiently strong, upward force by the contact plate 18 may be sufficient to force axial rotation of the scope 26 into proper orientation. When the bottom surface 18 of the saddle 24 is in flush contact with the contact plate 18 (FIG. 7), the cross hairs of the reticle 32 will be properly oriented relative to the scope mount unit 10 and the firearm to which it is attached. That is, a vertical element of the crosshair reticle 32 will be perpendicular to the top surface of the contact plate 18 (and to the bore axis of the firearm, not shown). A horizontal element of the crosshair reticle would be parallel to the top surface of the contact plate 18 (because the scope would have been manufactured with the horizontal element parallel to the bottom surface of the saddle 24).

In the case of a unitary mount, as illustrated, a scope 26 can be properly aligned with and secured to the mount unit 10 before it is attached to a firearm. In an embodiment where the base 16 is separate from the rings 12, 14, adjustment would be done as the scope is being mounted to the firearm.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A self-leveling mount for attaching a sighting scope, having a longitudinal optical axis and a saddle portion with a bottom surface, to a firearm, having a longitudinal barrel axis, comprising:

a body attachable to a firearm;

a pair of scope attachment rings axially spaced apart relative to the body so that at least a portion of the body is situated between the attachment rings; and a vertically movable contact plate on the body between the rings, the plate presenting an upper surface that is horizontally parallel to the longitudinal axis of a barrel of a firearm to which the body is attached and scope held by the attachment rings, wherein the contact plate makes adjustable alignment contact with the bottom surface of the saddle portion as the scope is held by the attachment rings.

2. The mount of claim 1, wherein the contact plate is spring biased toward alignment contact with the bottom surface of the saddle portion of the scope held by the attachment rings.

3. The mount of claim 1, wherein the attachment rings are attached to the body.

4. The mount of claim 1, wherein the attachment rings are integral with the body.

5. The mount of claim 1, wherein the body is adapted for attachment to a mounting rail of the firearm.

6. A method of attaching a sighting scope to a firearm having a longitudinal barrel axis, comprising the steps of:

providing a body attachable to a firearm;

providing a pair of scope attachment rings axially spaced apart relative to the body so that at least a portion of the body is situated between the attachment rings;

providing a vertically movable contact plate on the body between the rings, the plate presenting an upper surface that is horizontally parallel to longitudinal axes of a barrel of the firearm to which the body is attached and a scope held by the attachment rings, providing a scope having a longitudinal optical axis, a sighting reticle having a horizontal element, and a saddle portion bottom surface that is parallel to the horizontal element of the reticle;

positioning the scope in the attachment rings and moving the upper surface of the contact plate into aligned contact with the bottom surface of the saddle portion; and securing the scope in the attachment rings.

7. The method of claim 6, wherein the contact plate is spring biased toward alignment contact with the bottom surface of the saddle portion as the scope is held by the attachment rings.

8. The method of claim 6, wherein the attachment rings are attached to the body.

9. The method of claim 6, wherein the attachment rings are integral with the body.

10. The method of claim 6, wherein the body is adapted for attachment to a mounting rail of the firearm.

* * * * *